US005150129A

United States Patent [19]

Hara et al.

[11] Patent Number: 5,150,129

[45] Date of Patent: Sep. 22, 1992

[54] LIQUID JET RECORDING METHOD AND APPARATUS HAVING ELECTRO-THERMAL TRANSDUCER CONNECTED TO A HIGHER POWER SOURCE POTENTIAL SIDE THROUGH A SWITCH

[75] Inventors: Toshitami Hara, Tokyo; Hisanori Tsuda, Atsugi; Shinichi Hirasawa, Hiratsuka, all of Japan

[73] Assignee: Canon Kabushiki Kaisha, Tokyo, Japan

[21] Appl. No.: 525,315

[22] Filed: May 21, 1990

Related U.S. Application Data

[63] Continuation of Ser. No. 320,917, Mar. 8, 1989, abandoned, which is a continuation of Ser. No. 946,097, Dec. 23, 1986, abandoned, which is a continuation of Ser. No. 652,889, Sep. 21, 1984, abandoned.

[30] Foreign Application Priority Data

Sep. 26, 1983 [JP] Japan ..... 58-177284

[51] Int. Cl.[5] ..... B41J 2/05

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,091,391 | 5/1978 | Kozima | 346/76 R |
| 4,238,807 | 12/1980 | Bovio | 346/140 |
| 4,345,262 | 8/1982 | Shirato | 346/140 |
| 4,353,079 | 10/1982 | Kawanabe | 346/140 |
| 4,370,668 | 1/1983 | Hara | 346/140 |
| 4,401,993 | 8/1983 | Moriguchi | 346/76 PH |
| 4,429,321 | 1/1984 | Matsumoto | 346/140 |
| 4,438,191 | 3/1984 | Cloutier | 346/140 X |
| 4,450,457 | 5/1984 | Miyachi | 346/140 |
| 4,458,256 | 2/1984 | Shirato | 346/140 |

*Primary Examiner*—Joseph W. Hartary

*Attorney, Agent, or Firm*—Fitzpatrick, Cella, Harper & Scinto

[57] ABSTRACT

An apparatus for liquid-jet recording comprises an electro-thermal transducer and discharge openings for jetting a liquid by thermal action of the electrothermal transducer. The electro-thermal transducer is connected directly to a lower potential side of a power source and is connected to a higher potential side of the power source through a switch element. Thermal action of the thermal transducer occurs upon the application of a positive voltage of a high potential from the power source through the switch element.

3 Claims, 3 Drawing Sheets

LIQUID JET RECORDING METHOD AND APPARATUS HAVING ELECTRO-THERMAL TRANSDUCER CONNECTED TO A HIGHER POWER SOURCE POTENTIAL SIDE THROUGH A SWITCH

This application is a continuation of application Ser. No. 07/320,917 filed Mar. 8, 1989 which was a continuation of application Ser. No. 06/946,097 filed Dec. 23, 1986 which was a continuation of application Ser. No. 06/652,889 filed Sep. 21, 1984, all now abandoned.

BACKGROUND OF THE INVENTION

1. Field of the Invention

This invention relates to an apparatus for liquid-jet recording by jetting liquid droplets by heat generation to perform recording with the liquid droplets.

2. Description of the Prior Art

FIG. 1(*a*) is a cross-sectional plan view showing one example of the conventional liquid-jet recording head, and FIG. 1(*b*) is a cross-sectional view along the line A—A of FIG. 1(*a*) where heat-generating means composed of electro-thermal transducing parts 2 (as will be hereinafter referred to as "heat-generating parts) and electroconductive parts 3 are formed on a substrate 1, and a protective film (not shown in the drawings) is formed thereon. Each of the heat-generating parts 2 is partitioned by grooved plates 4 to form a liquid passage 5 having a thermal action chamber in which the heat energy generated by said heat-generating means acts on a liquid, and a liquid supply chamber 6. A discharge outlet 7 is provided at one end of the liquid passage 5, and the liquid is jetted from the discharge outlet. The liquid to be jetted is supplied through a liquid supply pipe 8 provided at the opposite side of the discharge outlet 7 across the heat-generating means to fill the liquid supply chamber 6 and the liquid passage 5.

The liquid can be jetted from the discharge outlets 7 by the heat generated at the heat-generating parts 2. The heat is generated by applying a predetermined pulse voltage to the electroconductive parts 3 connected with the heat-generating parts 2. When the voltage is applied thereto, the liquid near the heat-generating parts 2 undergoes rapid state changes accompanied by bubble formation by the generated heat energy, and the bubbles rapidly grow within the liquid passage 5. The liquid on the side of discharge outlet 7 is pushed out of the discharge outlet 7 rapidly by the generated pressure to form liquid droplets. The liquid droplets deposit onto a recording material to perform recording. When the applied voltage is turned off, the bubbles are rapidly contracted and vanished.

In such a liquid-jet head, a protective film is generally provided so that the electro-thermal transducing means having the heat-generating parts 2 and the electroconductive parts 3, i.e. a heat-generating means having a resistor and at least one pair of electrodes electrically connected with the resistor as counterposed to the heat generating part of the resistor may be protected from any contact with the liquid.

FIG. 2 is a cross-sectional view of detail of a the heat-generating part 2 of the liquid-jet recording head shown in FIG. 1(*b*), where a resistor 9 and an electrode 10 are formed on the substrate 1 and the part where there is only resistor 9 corresponds to the heat-generating part 2 in FIG. 1 and the part of the resistor 9 and the electrode 10 that overlap corresponds to the electroconductive part 3 in FIG. 1. The resistor 9 and electrode 10 comprising the heat-generating means is protected from a liquid 12 by a protective film 11.

The resistor 9 and electrode 10 have a risk of deterioration, changes in resistance or breaking-down due to chemical reactions such as oxidation reaction, electrolysis, etc., when brought into contact with the liquid 12. Thus, the protective film 11 is provided to prevent such a risk. The protective film 11 has no problem, so long as it is perfect, and the resistor 9 and electrode 10 are completely separated from the liquid 12, and a long life of the resistor 9 can be ensured.

However, it is actually very difficult to form such an ideal protective film. In the ordinary manufacturing process, fine defects 13 of less than a few microns are inevitably formed on the protective film 11, as shown in FIG. 2. Furthermore, defects 13 are also formed in the protective film 11 due to the thermal stress caused by the heat generation at the heat-generating part 2 of the resistor 9 or impacts, etc. caused by generation and vanishing of bubbles as described above.

FIG. 3 shows one example of a circuit structure of the conventional liquid-jet recording head, where the resistors 9 of the heat-generating part 2 and switching transistors 14 are connected with one another in series, and a plurality of the series connections are connected with one another in parallel. The higher voltage side of a power source 15 is connected with the resistors 9, and its lower voltage side (ground side) is connected with the switching transistors 14. Suppose that the ground potential is Vg and the potential on the resistor 9 side is Vh.

FIG. 4 is a diagram showing changes in voltage at the part A on the switching transistor 14 side of any of the resistors 9, where it is shown that a pulse-form voltage is applied to the resistor 9 by the on-off action of the switching transistor 14. The abscissa shows time, and the ordinate shows voltage.

In the circuit structure shown in FIG. 3, the potential Vink of liquid 12 (see FIG. 2), which may be hereinafter referred to merely "Vink", is substantially equal to Vh due to the defects formed on the protective film, when a given switching transistor 14 is in off state. The potential of the corresponding resistor 9 is Vh on the whole, and thus there is no difference in potential from the liquid 12. On the other hand, when the switching transistor 14 is on, an electric current passes through the resistor 9 to generate heat, and the potential at the part A of resistor 9 is lowered nearly to the ground voltage Vg at the same time. However, the potential Vink of liquid 12, may still remain nearly at Vh, and thus a potential difference of substantially Vh - Vg develops between the liquid 12 and the part A of resistor 9.

When the potential of liquid 12 is high and that of resistor 9 is low, as given above, it is known that an electric current is liable to pass to the resistor 9 through the defects 13 as shown in FIG. 2, and consequently electrochemical reaction is promoted between the electrode or the resistor and the liquid, and ultimately the resistor 9 will be damaged around the defects 13 and broken down. This is remarkable particularly when the defects 13 exist at the part A of resistor 13.

The rate of the reaction greatly depends on the species of resistor 9 and electrode 10, the heat-generating temperature of resistor 9, species of ions in the liquid, etc. When a defect 13 is formed at a heat-generating part 2, the heat-generating part 2 of resistor 9 is usually damaged and broken down only by about $10^5$ to $10^6$ applications of pulse voltage, through practically a durability to withstand at least about $10^8$ applications of pulse voltage is required.

Thus the presence of defects 13 on the protective film 11 shortens the life of heat-generating part 2 of resistor 9, and consequently shortens the life of the head, because breakage of only one resistor can terminate the life of the head, even if the head is of full-line multiorifice type. However, it is very difficult to completely remove the defects 13 as already described above. An increase in the thickness of protective film 11 must be avoided from the viewpoint of thermal conductivity. Thus in the production of the conventional recording heads, some heads with a short life are unavoidably involved, and the product reliability is considerably reduced.

SUMMARY OF THE INVENTION

The present invention has been established in view of said problems so far encountered in the prior art.

An object of the present invention is to provide an apparatus for liquid-jet recording with a practically long life, which is practically usable, even if a protective film for a heat generating means has the same level defects as that of the prior art.

According to the present invention, there is provided an apparatus for liquid-jet recording comprising electro-thermal transducing means and means for jetting a liquid by a thermal action of the electro-thermal transducing means. The electro-thermal transducing means is directly connected to the lower potential side of a power source and is connected through a switch element to the higher potential side of the power source for applying a positive voltage of a high potential to the electrothermal transducing means.

BRIEF DESCRIPTION OF THE DRAWINGS

FIG. 1(*b*) is a schematic cross-sectional view along the line A—A in FIG. 1(*a*).

DESCRIPTION OF THE PREFERRED EMBODIMENTS

Electrochemical reaction can be promoted when the potential Vink of a liquid is higher than the potential of resistor 9 (particularly at part A thereof), as already described above, the resistor 9 can hardly pass the electric current through the defects 13. That the electric current can hardly pass means that the electrochemical reaction can be suppressed, and consequently that the life of resistor 9 can be prolonged. The present invention utilizes this phenomenon.

Now, the present invention will be described in detail below, referring to an embodiment of the present invention by way of the drawings.

Figure 5:
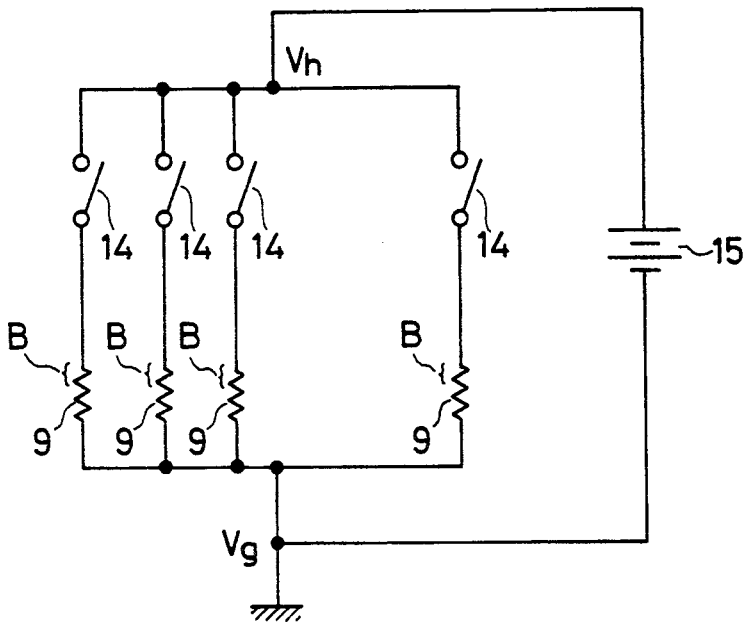
FIG. 5 is a circuit structure diagram according to one embodiment of the present apparatus for liquid-jet recording.
Figure 6:
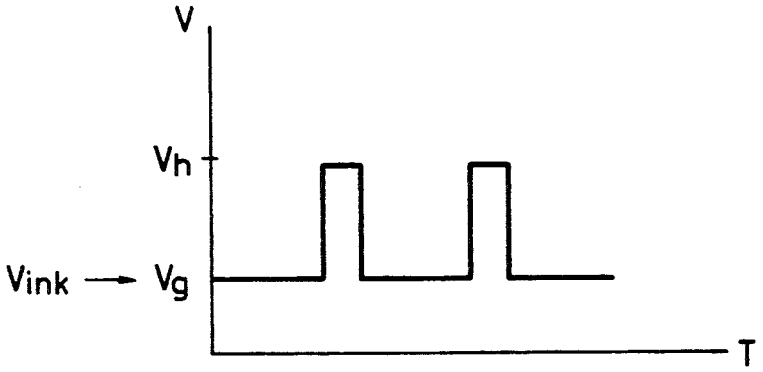
FIG. 6 is a diagram showing changes in voltage with time at parts B of the resistor shown in FIG. 5.

FIG. 5 is a circuit structure diagram showing one embodiment of the present apparatus for liquid-jet recording, and FIG. 6 is a diagram showing changes in voltage at the part B on the switching transistor 14 side of resistor 9, where the abscissa shows time and the ordinate shows voltage.

In FIG. 5, the resistors 9 (showing the heat-generating parts 2) and switching transistors 14 are arranged in series, and a plurality of the series connections are further connected with one another in parallel, and further connected with the switching transistor 14 side of power source 15, whereas the lower potential sides (ground side) thereof are connected with the resistor 9 side of the power source 15. Each of the switching transistors 14 performs the on-off action according to predetermined signals to supply a pulse form voltage to the corresponding resistor 9. The resistor 9 generates heat when the pulse-form voltage is applied thereto, and it is the energy by the heat generation that discharges liquid droplets from the discharge outlet 7.

In the circuit structure shown in FIG. 5, the potential of liquid 12, Vink, is substantially equal to the ground potential Vg. When a given switching transistor 14 is off, the resistor 9 corresponding to the switching transistor 14 is at the ground voltage Vg on the whole, and thus there is substantially no difference in potential between the liquid 12 and the resistor 9.

However, when a given switching transistor 14 is on, an electric current passes through the corresponding resistor 9 to generate heat. At that time, the potential at the part B of the resistor 9 is elevated nearly to Vh. Thus, a potential difference of substantially Vh - Vg develops between the liquid 12 and the resistor 9. Different from the conventional circuit structure shown in FIG. 3, the potential of the liquid, Vink, is lower than that of resistor 9 in the embodiment of FIG. 5. Thus, an electric current can hardly pass from the resistor 9 to the liquid 12, with the result that the electrochemical reaction can be suppressed, that is, the life of resistor 9 can be prolonged.

As described in detail above, the present apparatus for liquid-jet recording can suppress an electrochemical reaction between the liquid and the resistor by connecting the heat-generating resistor with the lower potential side of power source, even if there are the same level defects on the protective film as the conventional ones, making the life of the head longer. Thus, the present apparatus has a great effect on an increase in the product reliability.

Now, a specific test example will be given below.

Figure 1A:
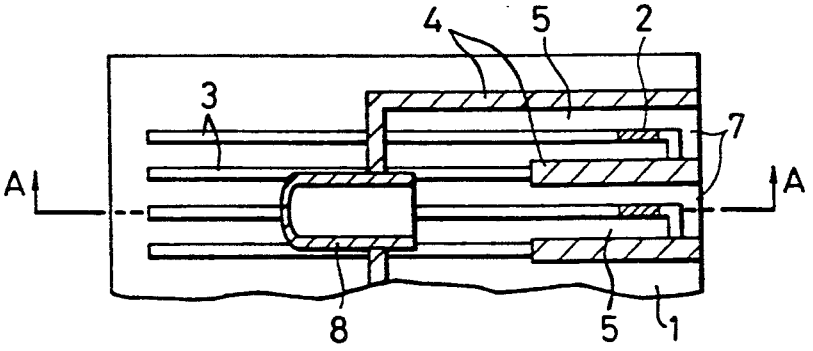
FIG. 1A PRIOR ART
FIG. 1(*a*) is a schematic, partially cut-away plan view showing an example of conventional liquid-jet recording head.
Figure 1B:
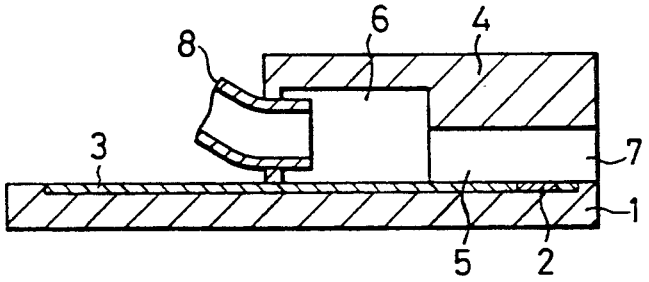
FIG. 1B PRIOR ART
Figure 2:
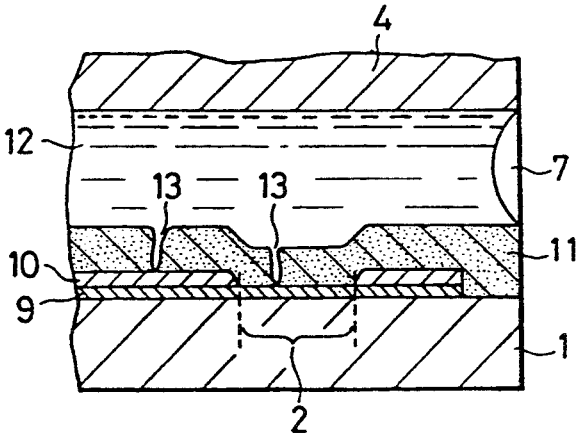
FIG. 2 PRIOR ART
FIG. 2 is a schematic, partial cross-sectional view showing detail of the heat-generating part in FIG. 1(*b*).

In FIG. 2, a $SiO_2$ film was formed to a thickness of 5 μm by thermal oxidation on a Si substrate 1, and then tantalum (Ta) was formed to a thickness of 2,000 Å as a resistor 9 thereof, and further gold (Au) to a thickness of 5,000 Å as an electrode 10 thereon. After a resistor pattern, 30 μm × 100 μm, was formed thereon by photolithography, $Ta_2O_5$ was deposited to a thickness of about 1 μm as a protective film 11 so as to lessen defects. The nozzle of the liquid-jet recording head thus manufactured was 40 μm wide, 40 μm high and 500 μm long.

Figure 3:
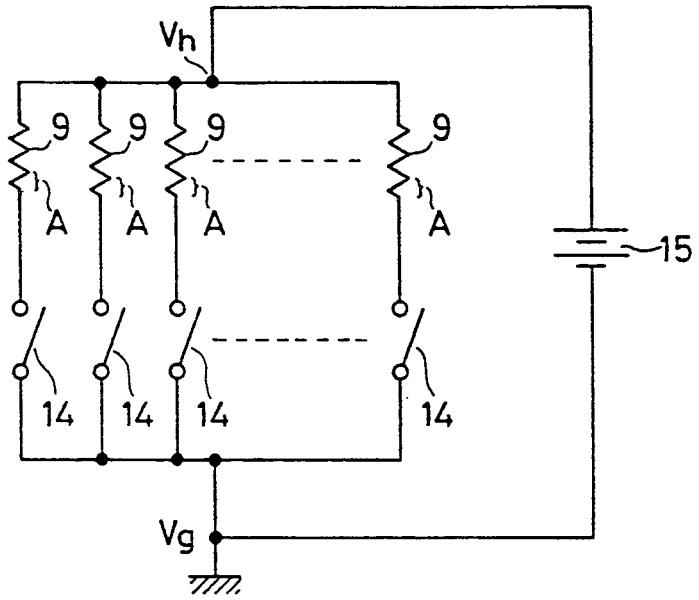
FIG. 3 PRIOR ART
FIG. 3 is a circuit structure diagram showing one example of a circuit for generating heat with resistors as used in the conventional liquid-jet recording head.
Figure 4:
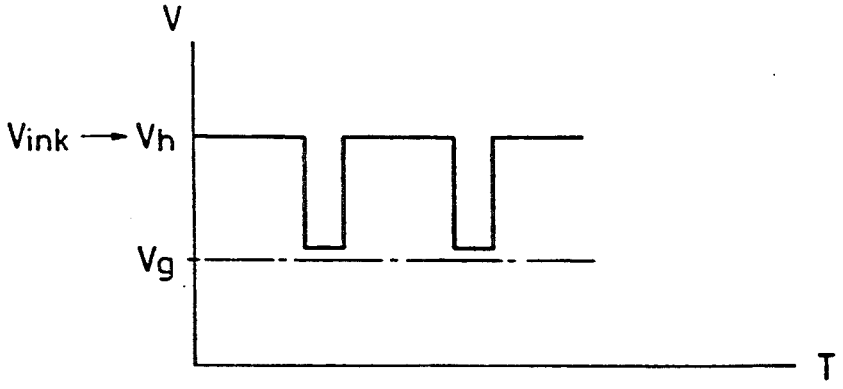
FIG. 4 PRIOR ART
FIG. 4 is a diagram showing changes in voltage at part A of the resistor shown in FIG. 3.

When $10^8$ runs of driving signal were inputted to the head in the conventional circuit structure of FIG. 3, the percentage of disordered nozzles was 5%, whereas, when $10^8$ runs of driving signal were inputted to the head in the circuit structure of the present embodiment of FIG. 5, such a good result as zero percent disorder of the nozzle was obtained.

What we claimed is:

1. A method for recording with a recording apparatus comprising a recording head having a plurality of discharge openings, said recording head comprising a plurality of liquid pathways corresponding to said discharge openings, each pathway communicating with one of said discharge openings for storing the liquid to be discharged from said discharge openings, a plurality of heat generating resistor members, at least one formed within each of said liquid pathways to form a heat generating portion for providing the liquid with heat energy, a plurality of electrical switch elements, at least one connected to each of said plurality of resistor members, a plurality of pairs of electrodes, at least one pair connected to each of said resistor members, and a power source for applying a voltage to the heat generating resistor members to generate heat energy utilized when discharging the liquid, wherein said power source is connected to one electrode side of said heat generating resistor members at a higher potential side of said power source through each of said plurality of electrical switch elements, and wherein a lower potential side of said power source or ground is directly connected to the other electrode side of said heat generating resistor members, said method comprising:

a non-recording step in which said electrical switch elements are in a non-connecting position when no recording signal is inputted, wherein said heat generating resistor members are connected to the lower potential side of said power source or to ground, and therefore the liquid electrically in contact with said resistor members is connected to the low potential state or ground; and a recording step in which said electrical switch elements are in a connecting position when a recording signal is inputted, wherein a state change occurs and a bubble is formed in the liquid from heat energy generated from application of a positive voltage of a high potential to said heat generating resistor members, said high potential being generated upon driving selectively said electrical switch elements to connecting positions in response to an input recording signal, whereby the liquid is displaced by the bubble and discharged from said discharge opening to attach to a recording medium, thereby performing recording.

2. A liquid discharge recording apparatus comprising:

a recording head comprising:

a plurality of discharge openings for discharging a liquid;

a plurality of liquid pathways corresponding to said discharge openings, each pathway communicating with one of said discharge openings for storing the liquid to be discharged from said discharge openings;

a plurality of heat generating resistor members, at least one formed within each of said liquid pathways to form a heat generating portion for providing the liquid with heat energy;

a plurality of electric switch elements, at least one electrically connected to each resistor member;

a plurality of pairs of electrodes, at least one pair connected electrically to each of said plurality of resistor members; and a power source for applying a voltage to said heat generating resistor members to generate heat energy to be utilized when discharging the liquid;

whereby said plurality of heat generating resistor members are connected in parallel to said power source, one electrode side connecting each of said plurality of heat generating resistor members to a higher potential side of said power source through each of said plurality of switch elements, and the other electrode side connecting each of said plurality of heat generating resistor members directly to a lower potential side of said power source, wherein a state change occurs and a bubble is formed in the liquid from heat energy generated from application of a positive voltage of a high potential from said power source on said heat generating resistor member, said high potential being generated upon driving selectively said electrical switch element in response to an input recording signal, whereby the liquid is displaced by the bubble and discharged from said discharge opening.

3. A liquid discharge recording apparatus comprising:

a full-line type recording head comprising:

a plurality of discharge openings for discharging a liquid provided over the entire width of a recording region of a recording medium where a recorded image is to be formed by attachment of said liquid;

a plurality of liquid pathways corresponding to said discharge openings, each pathway communicating with one of said discharge openings for storing the liquid to be discharged from said discharge openings;

a plurality of heat generating resistor members, at least one formed within each of said liquid pathways to form a heat generating portion for providing the liquid with heat energy;

a plurality of electrical switch elements, at least one connected to each of said plurality of resistor members;

a plurality of pairs of electrodes, at least one pair connected electrically to each of said resistor members; and a power source for applying a voltage to said heat generating resistor members to generate heat energy to be utilized when discharging the liquid, whereby said plurality of heat generating resistor members are connected in parallel to said power source, one electrode side connecting each of said plurality of heat generating resistor members to a higher potential side of said power source through each of said plurality of electrical switch elements, and the other electrode side connecting each of said plurality of heat generating resistor members directly to a lower potential side of said power source, wherein a state change occurs and a bubble is formed in the liquid from heat energy generated from application of a positive voltage of a high potential to said heat generating resistor members, said high potential being generated upon driving selectively said electrical switch elements in response to an input recording signal, whereby the liquid is displaced by the bubble and discharged from said discharge opening.

* * * * *

UNITED STATES PATENT AND TRADEMARK OFFICE

CERTIFICATE OF CORRECTION

PATENT NO. : 5,150,129

DATED : September 22, 1992

INVENTOR(S) : TOSHITAMI HARA, ET AL.

It is certified that error appears in the above-identified patent and that said Letters Patent is hereby corrected as shown below:

On the title page, Item

[56] REFERENCES CITED - U.S. PATENT DOCUMENTS

"4,458,256 2/1984" should read --4,458,256 7/1984--.

COLUMN 1:

Line 53, "vanished." should read --vanish.--;

Line 62, "of detail of a" should read --of a detail of--.

COLUMN 2:

Line 2, "is" should read --are--;

Line 62, "resistor 13." should read --resistor 9.--.

UNITED STATES PATENT AND TRADEMARK OFFICE

CERTIFICATE OF CORRECTION

PATENT NO. : 5,150,129 Page 2 of 2

DATED : September 22, 1992

INVENTOR(S) : TOSHITAMI HARA, ET AL.

It is certified that error appears in the above-identified patent and that said Letters Patent is hereby corrected as shown below:

COLUMN 3:

Line 1, "through" should read --though--.

COLUMN 5:

Line 3, "claimed" should read --claim--.

Signed and Sealed this

Seventh Day of December, 1993

*Attest:*

Bruce Lehman

BRUCE LEHMAN

*Attesting Officer*

*Commissioner of Patents and Trademarks*